US007040496B2

(12) United States Patent
Hakala

(10) Patent No.: US 7,040,496 B2
(45) Date of Patent: May 9, 2006

(54) ARRANGEMENT FOR PLACING CRANE MECHANISMS

(75) Inventor: Ilpo Hakala, Espoo (FI)

(73) Assignee: KCI Konecranes PLC, Hyvinkää (FI)

( * ) Notice: Subject to any disclaimer, the term of this patent is extended or adjusted under 35 U.S.C. 154(b) by 208 days.

(21) Appl. No.: 10/469,732

(22) PCT Filed: Mar. 22, 2002

(86) PCT No.: PCT/FI02/00245

§ 371 (c)(1),
(2), (4) Date: Sep. 3, 2003

(87) PCT Pub. No.: WO02/076873

PCT Pub. Date: Oct. 3, 2002

(65) Prior Publication Data

US 2004/0069734 A1 Apr. 15, 2004

(30) Foreign Application Priority Data

Mar. 23, 2001 (FI) ..... 20010606

(51) Int. Cl.
*B66C 13/08* (2006.01)

(52) U.S. Cl. ..... 212/274; 212/323

(58) Field of Classification Search ..... 212/274, 212/320–323

See application file for complete search history.

(56) References Cited

U.S. PATENT DOCUMENTS

| | | | | |
|---|---|---|---|---|
| 3,874,516 | A * | 4/1975 | Watanabe | 212/87 |
| 3,900,114 | A * | 8/1975 | Inoue et al. | 212/83 |
| 5,769,250 | A | 6/1998 | Jussila et al. | |
| 6,631,816 | B1 * | 10/2003 | Miyazawa et al. | 212/272 |

FOREIGN PATENT DOCUMENTS

| | | | |
|---|---|---|---|
| GB | 1 400 090 | | 7/1975 |
| JP | 9-142774 | * | 6/1997 |
| JP | 10-265173 | * | 10/1998 |
| JP | 2000-191275 | * | 7/2000 |

* cited by examiner

*Primary Examiner*—Thomas J. Brahan
(74) *Attorney, Agent, or Firm*—Birch, Stewart, Kolasch & Birch, LLP

(57) ABSTRACT

The invention relates to an arrangement for placing crane mechanisms, the crane comprising lifting mechanisms (1) with lifting drums (2), lifting ropes (3) in the lifting drums, a lifting trolley (4), a loading element (5) suspended from the lifting trolley (4) by the lifting ropes (3), four auxiliary mechanisms (10) controlling the swaying and twisting of the loading element (5) and the load (9) fastened to it, auxiliary ropes (12) in the rope drums (11) of the auxiliary mechanisms (10), and turning sheaves (13) of the auxiliary ropes (12) in the loading element (5). The lifting mechanisms (1) and lifting drums (2) are fixed to the frame of the crane, the auxiliary mechanisms (10) with their rope drums (11) are located in the lifting trolley (4), and the auxiliary ropes (12) are led from the turning sheaves (13) to a storage drum (14) for the auxiliary ropes in the lifting trolley (4), the storage drum being equipped with an additional mechanism (15) that is independent of the lifting mechanisms (1).

1 Claim, 1 Drawing Sheet

ARRANGEMENT FOR PLACING CRANE MECHANISMS

This application is the national phase under 35 U.S.C. § 371 of PCT International Application No. PCT/FI 02/00245 which has an International filing date of Mar. 22, 2002, which designated the United States of America.

BACKGROUND OF THE INVENTION

The invention relates to an arrangement for placing crane mechanisms, the crane comprising lifting mechanisms with lifting drums, lifting ropes arranged to the lifting drums, a lifting trolley, a loading element suspended from the lifting trolley by the lifting ropes and having turning sheaves for the lifting ropes for guiding the lifting ropes back to the lifting trolley, four auxiliary mechanisms independent of the lifting mechanism and each other for controlling the swaying and twisting of the loading element and the load fastened to it, auxiliary ropes in the rope drums of the auxiliary mechanisms, and turning sheaves of the auxiliary ropes in the loading element, through which the auxiliary ropes that are led to them diagonally from the rope drums of the auxiliary mechanisms are directed back to the lifting trolley, wherein the auxiliary mechanisms with their rope drums are located in the lifting trolley, and the auxiliary ropes are led from the turning sheaves of the auxiliary ropes to a storage drum for auxiliary ropes in the lifting trolley.

Mechanical load control implementations are generally located in the mechanism trolleys of container cranes. Placing the mechanisms and rope mechanisms in question in the trolley, in which the load lifting mechanisms also reside, is natural. The drawback of mechanism trolleys in comparison with rope trolleys or lifting trolleys is their heavier weight that in certain cases results in that the structure of the entire crane becomes too heavy and it does not fit on the pier of the terminal.

The structure of a rope trolley or lifting trolley differs from the mechanism trolley in that the actual mechanisms (lifting mechanism and/or trolley transfer mechanism) reside in a separate machine room at the back of the crane. The rope system arranged for lifting a load is led to the mechanisms in the machine room by means of the turning sheaves fastened to the boom structure of the crane.

GB patent 1 400 090 discloses a crane, in which the invention comprises a separate sheave block that can move vertically in relation to the actual load suspension element. The movement in question is explained as a possibility to stop the diagonal ropes from touching the cargo hold of a ship, for instance, when lowering the loading element.

In DE patent applications 29 17 588 and 32 77 329, damping mechanisms and ropes are hydraulic and the actual damping devices (hydraulic cylinders) reside in the loading element. The drum of the diagonal ropes located separate from the lifting mechanism in the trolley is connected directly and fixedly to the lifting rope drum. These applications concentrate on developing different hydraulic solutions.

BRIEF DESCRIPTION OF THE INVENTION

It is an object of the present invention to developed the crane mentioned in the beginning so as to make the crane that is equipped with an efficient load control arrangement fit better than before to the pier. This object is achieved by the crane of the invention that is characterized in that the lifting mechanisms with their lifting drums are fixed to the structural frame of the crane, and the storage drum is equipped with an additional mechanism that is independent of the lifting mechanisms, but can be controlled in a synchronized manner with them.

The invention is based on the idea that each mechanism is placed so as to be in the most advantageous position for both operation and structural durability.

The solution of the invention provides the advantages that efficient load control can be provided in a light rope trolley structure and the structure of the trolley remains simple and essentially lighter than that of a mechanism trolley.

The crane structure proposed herein differs from known arrangements in that the essential parts of the diagonal ropes, the auxiliary mechanisms, which provide a control that prevents swaying and dampens the force of the diagonal ropes, reside in the lifting trolley. Only the turning sheaves of the diagonal ropes are located in the loading element, which is why the weight of the loading element can be kept substantially smaller than in the known solutions. This reduces the stress to the lifting mechanism. The loading element also does not require additional components needing maintenance and control, as in hydraulic systems.

The control of the diagonal ropes can be implemented electronically by means of a frequency converter, as in FI patent 101466, whereby the force of each of the four separate diagonal ropes can be independently controlled to prevent the swaying of the load.

The independent control of the auxiliary mechanisms of the four separate diagonal ropes also makes it possible that by tightening the mechanisms on one side of the loading element and by loosening the mechanisms on the opposing side, the loading element can be moved horizontally in the direction of travel of the trolley or transverse to its direction of travel. In addition, by performing corresponding action on the mechanisms located crosswise with respect to the loading element, the loading element can be rotated with respect to its vertical axis. All above-mentioned movements are necessary when positioning the loading element and are typically provided in container cranes by means of separate screw mechanisms installed at the ends of the actual lifting rope.

The drum located in the trolley and serving as the rope storage for diagonal ropes is equipped with a separate mechanism that can be controlled separately from the actual lifting mechanism. This is an essential property especially when the loading element approaches its top position, when due to the geometry of the diagonal ropes, the winding rate of the lifting ropes and diagonal ropes must differ from each other, if a standard speed is to be maintained for the load.

The rope geometry can be implemented according to FI patent application 20002030, for instance. A general problem with known solutions of rope geometry is that with the lifting heights currently used in container cranes, the diagonal ropes intersect, and this type of implementation cannot be used. In the solution of GB patent 1 400 090, this problem does not exist, but this arrangement only works in one direction (diagonal ropes only in the direction of travel of the trolley).

BRIEF DESCRIPTION OF THE FIGURES

The invention will now be described in more detail in light of one preferred embodiment with reference to the attached drawing that shows a general view of a crane of the invention.

DETAILED DESCRIPTION OF THE INVENTION

Figure 1:
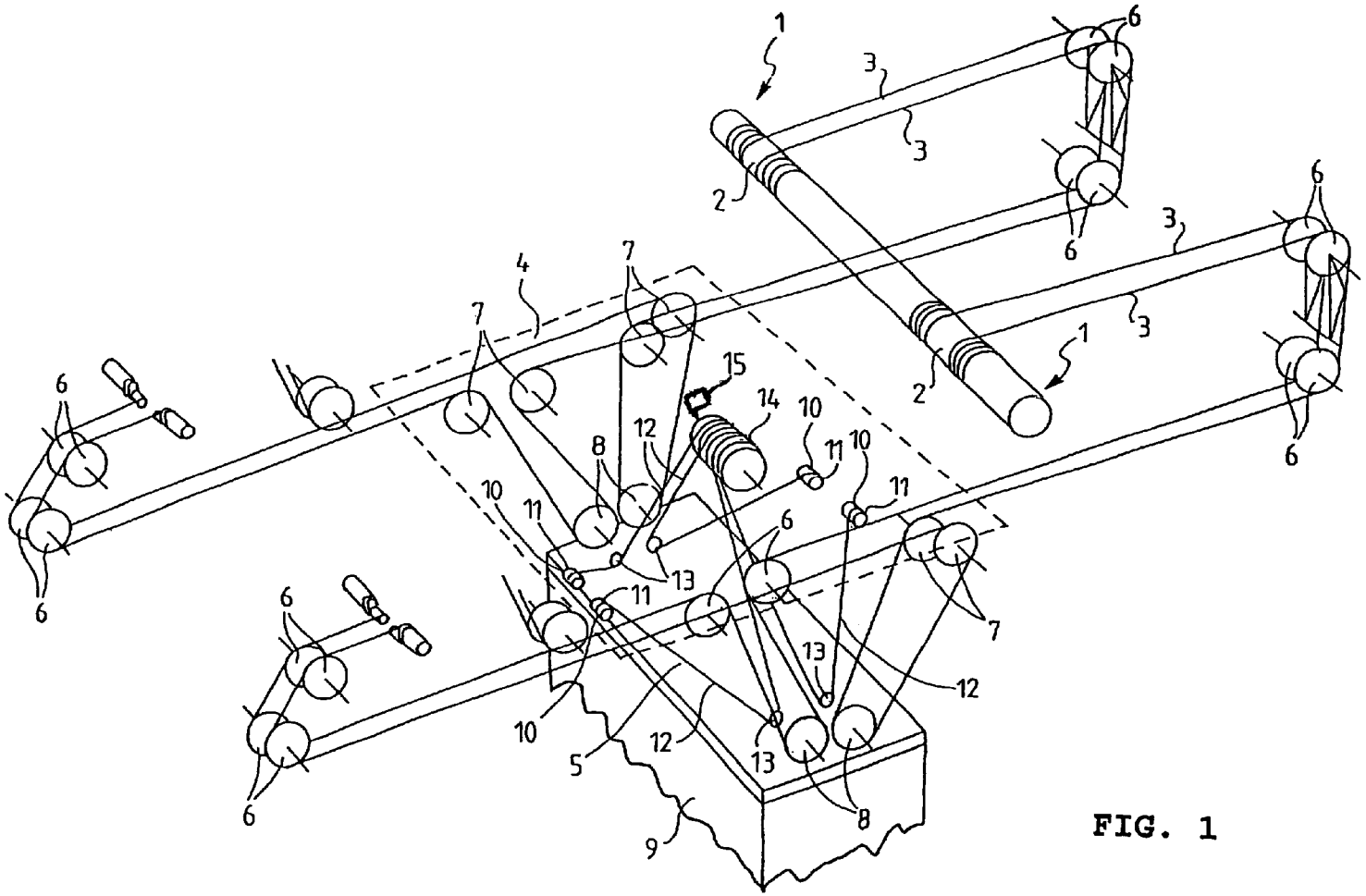

With reference to FIG. 1, the crane of the invention comprises lifting mechanisms 1 with integrated lifting drums 2; lifting ropes 3 arranged in each lifting drum 2; a lifting trolley 4 that moves along the main girder (not shown) of the crane; a loading element 5, to which the lifting ropes 3 are led through turning sheaves 6 in the structural frame (not shown) of the crane and turning sheaves 7 in the lifting trolley 4, and from which loading element 5, the lifting ropes 3 are led through the turning sheaves 8 in it back to the lifting trolley 4, whereby the loading element 5 is suspended from the lifting trolley by these ropes 3.

In addition, there are four auxiliary mechanisms 10 independent of the lifting mechanism 1 and each other for controlling the swaying and twisting of the loading element 5 and the load 9 fastened thereto by means of auxiliary ropes 12 in the rope drums 11 of each auxiliary mechanism 10, the loading element 5 having turning sheaves 13 of the auxiliary ropes, through which the auxiliary ropes 12 led to them diagonally from the rope drums 11 of the auxiliary mechanisms 10 are led back to the lifting trolley 4.

The lifting mechanisms 1 with their lifting drums 2 are fixed to the structural frame of the crane in a separate machine room (not shown), for instance, and the auxiliary mechanisms 10 with their rope drums 11 are in the lifting trolley 4, and the auxiliary ropes 12 are led from the turning sheaves 13 of the auxiliary ropes to a storage drum 14 for the auxiliary ropes located in the lifting trolley, the storage drum being equipped with driving apparatus 15 that is independent of the lifting mechanisms but can be controlled in a synchronized manner with them. The driving apparatus includes a motor and necessary gearing to drive the storage drum 14. The driving apparatus operates when the lifting mechanism is operating.

The auxiliary mechanisms 10 are preferably arranged in the form of a rectangle in such a manner that one auxiliary mechanism 10 is located in each corner of the rectangle. The turning sheaves 13 are also preferably arranged in the form of a rectangle in such a manner that one turning sheave 13 is located in each corner of the rectangle. The diagonal arrangement of the auxiliary ropes 12 is necessary so as to be able to exert to the loading element 5 and the load by means of the auxiliary mechanisms 10 and auxiliary ropes the horizontal forces necessary to prevent or dampen swaying or twisting. Because of this, the lifting ropes 3 can also be completely vertical, if necessary.

The auxiliary mechanisms 10 can be identical, mechanically independent systems according to FI patent 101466, for instance, the control of which is completely electronic and determined on the basis of the weighing data of each auxiliary rope 12, the torque data of each auxiliary mechanism motor, the rotating rate of the rope drum 11 or any other variable of this kind. There is always enough auxiliary rope 12 stored on the rope drum 11, whereby the compensation caused by the different geometries of the auxiliary ropes 12 and the lifting ropes 3 is automatically solved. By means of the control system controlling the auxiliary mechanisms 10, the forces exerted to each auxiliary rope 12 are controlled on the basis of the above-mentioned variables in such a manner that the loading element 5 and the load suspended from it cannot sway or twist. A fully symmetrical placement of the auxiliary mechanisms 10 is not necessary, since by means of said control system, the asymmetry can be taken into account, as it is known in advance. This known method is described in greater detail in said patent.

The above description of the invention is only intended to illustrate the basic idea of the invention. A person skilled in the art can thus implement its details in many different ways without deviating from the limits defined in the attached claims.

The invention claimed is:

1. An arrangement for placing crane mechanisms, the crane comprising a lifting mechanism (1) with at least one lifting drum (2), lifting ropes (3) arranged to the lifting drum (2), a lifting trolley (4), a loading element (5) suspended from the lifting trolley (4) by the lifting ropes (3) and having turning sheaves (8) for the lifting ropes for guiding the lifting ropes back to the lifting trolley, four auxiliary mechanisms (10) independent of the lifting mechanism (1) and each other for controlling the swaying and twisting of the loading element (4) and a load (9) fastened to it, auxiliary ropes (12) in rope drums (11) of the auxiliary mechanisms (10), and turning sheaves (13) of the auxiliary ropes (12) in the loading element (9), through which the auxiliary ropes that are led to them diagonally from the rope drums (11) of the auxiliary mechanisms are directed back to the lifting trolley (4), wherein the auxiliary mechanisms (10) with their rope drums (11) are located in the lifting trolley (4), and the auxiliary ropes (12) are led from the turning sheaves (13) of the auxiliary ropes to a storage drum (14) for auxiliary ropes in the lifting trolley (4), wherein the lifting mechanism (1) with the at least one lifting drum (2) are fixed to a structural frame of the crane, and the storage drum (14) is equipped with a driving apparatus (15) that is independent of the lifting mechanism (1), and controlled in a synchronized manner therewith.

* * * * *